US006648586B1

(12) United States Patent
Catoe et al.

(10) Patent No.: US 6,648,586 B1
(45) Date of Patent: Nov. 18, 2003

(54) SAMPLE CHIP COLLATING APPARATUS

(75) Inventors: Wilton T. Catoe, Temple, TX (US); Garland R. Wentrcek, Belton, TX (US)

(73) Assignee: Premark RWP Holdings Inc., Wilmington, DE (US)

( * ) Notice: Subject to any disclaimer, the term of this patent is extended or adjusted under 35 U.S.C. 154(b) by 285 days.

(21) Appl. No.: 09/281,093

(22) Filed: Mar. 30, 1999

(51) Int. Cl.[7] ..... B65G 57/09

(52) U.S. Cl. ..... 414/788.4; 414/791.6; 414/792.7; 198/418.3; 221/112

(58) Field of Search ..... 414/788.4, 789.6, 414/791.6, 792.7, 792.8, 792.9, 793, 801, 802; 198/418.3, 418.2, 418.1; 221/95, 92, 112

(56) References Cited

U.S. PATENT DOCUMENTS

| | | | | |
|---|---|---|---|---|
| 2,589,728 A | | 3/1952 | Pearce | |
| 2,626,038 A | * | 1/1953 | Smith | 198/418.3 |
| 2,704,593 A | | 3/1955 | Galloway | |
| 2,790,536 A | | 4/1957 | Reed | |
| 2,977,733 A | | 4/1961 | Pearce | |
| 3,002,746 A | | 10/1961 | Lloyd et al. | |
| 3,158,366 A | | 11/1964 | Godlewski | |
| 3,371,767 A | | 3/1968 | Rehr et al. | |
| 3,443,706 A | * | 5/1969 | Puhm | 414/801 |
| 3,914,154 A | | 10/1975 | Pfeiffer | |
| 3,954,165 A | | 5/1976 | Snyder | |
| 3,978,571 A | * | 9/1976 | Orlando et al. | 29/730 |
| 4,073,373 A | * | 2/1978 | Crowley et al. | 198/418.3 |
| 4,354,589 A | * | 10/1982 | Fluck | 198/358 |
| 4,427,329 A | * | 1/1984 | Milholen | 414/792.6 |
| 4,639,873 A | * | 1/1987 | Baggarly et al. | 705/406 |
| 4,824,306 A | * | 4/1989 | Stevenson | 414/788.4 |
| 4,842,808 A | * | 6/1989 | Rieben et al. | 376/261 |
| 5,181,704 A | | 1/1993 | Roblin | |
| 5,328,319 A | | 7/1994 | Fadaie | |
| 5,494,273 A | | 2/1996 | Hansch | |
| 5,657,979 A | | 8/1997 | Bruce et al. | |
| 6,044,957 A | * | 4/2000 | Guttinger | 198/418.3 |

* cited by examiner

*Primary Examiner*—Robert P. Olszewski
*Assistant Examiner*—Gerald J. O'Connor
(74) *Attorney, Agent, or Firm*—Welsh & Flaxman LLC

(57) ABSTRACT

A collating for collecting sample chips includes a framework supporting a plurality of supply bins housing sample chips and a track running adjacent the plurality of supply bins. The apparatus further includes at least one collection bin shaped and dimension for movement on the track and at least one gantry for transferring sample chips from the plurality of supply bins to the at least one collection bin when the at least one collection bin is aligned with respective supply bins.

20 Claims, 7 Drawing Sheets

SAMPLE CHIP COLLATING APPARATUS

BACKGROUND OF THE INVENTION

1. Field of the Invention

The invention relates to an apparatus for collating sample chips. More particularly, the invention relates to an apparatus for automatically collating sample laminate chips used at design centers for the selection of proper laminates.

2. Description of the Prior Art

Those who have redone a kitchen or bathroom have been confronted with choosing an appropriate countertop. In many cases, the individuals choose from a variety of decorative laminates used in the fabrication of countertops.

The choice can often be overwhelming when one considers the vast number of available colors and designs. Since providing complete sheets of laminate for consideration by consumers is not practical, laminate manufacturers commonly provide design centers with laminate samples from which consumers may choose a desired laminate for the fabrication of a countertop, or other decorative laminate product.

Decorative laminate samples are commonly small chips which are approximately 2" by 3". Each chip includes a hole for displaying and retaining the chips in an organized manner. Generally, the chips are displayed either on a board from which many samples are hung or on a sample chip chain. While a board may be a convenient display for use within a store, a board may not be conveniently moved from place to place, and sample chips are, therefore, frequently held on a sample chip chain.

Sample chip chains are commonly assembled by stringing a variety of sample chips on a single flexible chain. Sample chip chains have previously been manually assembled. The people assembling the sample chip chains carefully collect the hundreds of different sample chips and place the chips on a flexible chain. As can well be appreciated, this is a highly time consuming endeavor.

As such, a need exists for an apparatus which conveniently and reliably collects the hundreds of sample chips for use on sample chip chains. The present invention provides such an apparatus.

SUMMARY OF THE INVENTION

It is, therefore, an object of the present invention to provide a collating apparatus for collecting sample chips. The collating apparatus includes a framework supporting a plurality of supply bins housing sample chips and a track running adjacent the plurality of supply bins. The apparatus further includes at least one collection bin shaped and dimensioned for movement on the track and at least one gantry for transferring sample chips from the plurality of supply bins to the at least one collection bin when the at least one collection bin is aligned with respective supply bins.

It is also an object of the present invention to provide a method for collecting sample chips. The method is achieved by housing a plurality of different sample chips respectively within a plurality of supply bins, moving a collection bin past the plurality of supply bins, moving a sample chip from a supply bin to the collection bin when the collection bin is aligned with the supply bin, and repeating the steps of moving a collection bin and moving a sample chip for each of the plurality of supply bins.

Other objects and advantages of the present invention will become apparent from the following detailed description when viewed in conjunction with the accompanying drawings, which set forth certain embodiments of the invention.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
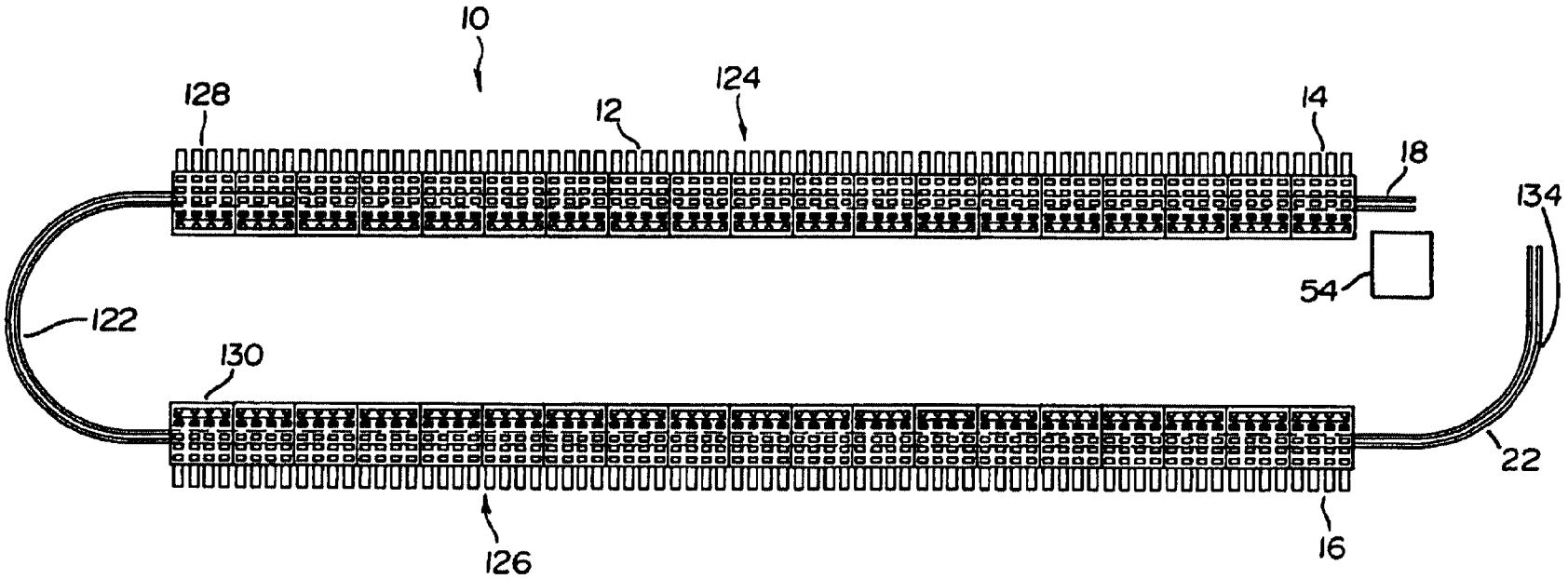
FIG. 1 is a top schematic view of the present apparatus.

With reference to FIG. 1, a schematic of the present collating apparatus 10 is disclosed. The apparatus 10 is composed of a plurality of distinct collating stations 12 assembled to create a complete collating apparatus 10. The collating stations 12 are assembled end to end with a starting collating station 14 and a finishing collating station 16. In accordance with the preferred embodiment of the present invention, thirty-eight collating stations (each station holds eight different chips for a maximum total of 304 chips to be assembled) are assembled end to end in an oval configuration.

The modular nature of each collating station 12 allows damaged collating stations to be readily replaced without requiring repair of the entire system. This allows the system to continue running while problems with a damaged collating station are repaired.

As will be better appreciated from the following description, the assembled collating apparatus 10 includes a starting end 18 at which collection bins 20 are inserted within the apparatus 10 to begin their movement, as well as a finishing end 22 at which the collection bins reach the end of a cycle. While the disclosed embodiment includes an oval configuration composed of thirty-eight collating stations, the shape of the assembly, as well as the number of collating stations, may be varied to suit the needs of the required collating job.

Briefly, each collating station 12 includes a housing framework 24, a plurality of supply bins 26*a–d*, 28*a–d* housing sample chips 34, a track 36 upon which collection bins 20 ride through the present collating apparatus 10, and a gantry 38 which orderly collects sample chips 34 from the supply bins 26*a–d*, 28*a–d* and places the sample chips 34 within the collection bins 20 as they pass through each collating station 12.

With reference to FIGS. 2–7, a single collating station 12 is disclosed. The collating station 12 includes a housing framework 24 supporting the functional components of the collating station 12. The housing framework 24 of the collating station 12 includes a horizontal support platform 40 upon which the gantry 38 is supported. The horizontal support platform 40 also includes a series of supply bin openings 42*a–d*, 43*a–d* and collection bin openings 44*a–d* providing the gantry 38 with access to the plurality of supply bins 26*a–d*, 28*a–d* stored below the horizontal support platform 40, as well as the collection bins 20 passing through the collating station 12.

In accordance with the preferred embodiment of the present invention, the horizontal support platform 40 includes four rows of three aligned openings. Each row includes a pair of supply bin openings 42*a–d*, 43*a–d* for two respectively aligned supply bins 26*a–d*, 28*a–d* supported by a pull out drawer 46*a–d*. Each row further includes a collection bin 44*a–d* opening for the collection bins 20 which pass through the collating station 12 in the manner discussed below in greater detail. While the disclosed embodiment includes twelve openings providing access to the various bins supported below the horizontal support platform 40, variations in the shape, number and spacing of the openings may be made without departing from the spirit of the present invention.

As briefly discussed above, the collating station 12 includes four pairs of supply bins 26*a–d*, 28*a–d*. Each pair of supply bins 26*a–d*, 28*a–d* is supported by a pull out drawer 46*a–d* aligned with a row of supply bin openings 42*a–d*, 43*a–d*. In this way, the supply bins 26*a–d*, 28*a–d* may be selectively moved between a functional position aligned with the supply bin openings 42*a–d*, 43*a–d* within the collating station 12 and an exposed withdrawn position (see FIG. 2). When the supply bins 26*a–d*, 28*a–d* are in their withdrawn position, the operator may check the supply of sample chips 34 within each supply bin 26*a–d*, 28*a–d* and replace sample chips 34 when required.

Each pull out drawer 46*a–d* includes a twist handle 48 which locks the drawer in its functional position. When an operator wishes to withdraw the pull out drawer 46*a–d*, the handle 48 is unlocked by simply twisting and pulling outwardly to withdraw the selected supply bins 26*a–d*, 28*a–d*. Each handle 48 includes a camming member 50. The camming member 50 contacts a sensor 52 when the drawer 46*a–d* is properly locked in position. When the drawer 46*a–d* is not properly lock in position, the sensor 52 is activated and the central control system 54 is instructed to shut down the station 12.

As will be discussed in greater detail, the central control system 54 is in communication with all of the collating stations 12, and functions to control the overall operation of the apparatus 10. In addition, to the inclusion of a central control system 54, each collating station 12 is provided with a processing unit 120. The processing unit 120 is designed to control the functioning of the individual collating stations, while also interfacing with the control system 54.

The gantry 38 is supported on the horizontal support platform 40 for linear movement thereon. In use, the gantry 38 retrieves sample chips 34 from the supply bins 26*a–d*, 28*a–d* and moves the sample chips 34 into the collection bins 20 aligned with respective supply bins 26*a–d*, 28*a–d*. With this in mind, the gantry 38 includes a plurality of vacuum arms 56*a–d*. Each vacuum arm 56*a–d* is designed to selectively reach into an aligned supply bin 26*a–d*, 28*a–d*, pick up a sample chip 34 within the supply bin 26*a–d*, 28*a–d*, withdraw the sample chip 34 from the supply bin 26*a–d*, 28*a–d*, move to the collection bin opening 44*a–d*, reach into the collection bin 20 and place the sample chip 34 within the collection bin 20 (see FIGS. 5–7).

Specifically, the gantry 38 is supported on first and second tracks 58, 59 located on the horizontal support platform 40. The central tracks 58, 59 are arranged and designed to provide the gantry 38 with access to the various bin openings formed within the horizontal support platform 40. In accordance with the preferred embodiment of the present invention, the first and second tracks 58, 59 are substantially T-shaped and the gantry 38 includes two T-shaped grooves 60, 61 which respectively ride on the T-shaped tracks 58, 59. However, those skilled in the art will certainly appreciate the wide variety of track designs which may be used in accordance with the spirit of the present invention.

Linear movement of the gantry 38 along the tracks 58, 59 is controlled by pneumatic controls 62 interfaced with the processing unit 120 of the collating station 12. The pneumatic controls 62 moves the gantry 38 along the tracks 58, 59. Specifically, the pneumatic controls 62 are designed to move the gantry 38 into alignment with the supply bin openings 42*a–d*, 43*a–d* and the collection bin openings 44*a–d* in a highly controlled manner. With this in mind, the tracks 58, 59 are provided with various sensors 64 sending information to the processing unit 120 and central control system 54 regarding the exact position of the gantry 38.

As discussed above, the gantry 38 includes a plurality of vacuum arms 56*a–d*. With reference to FIGS. 2–7, and in accordance with the disclosed embodiment of the present invention, the gantry 38 includes a support framework 66 upon which four vacuum arms 58*a–d* are supported. While four vacuum arms are disclosed in accordance with the preferred embodiment, the number of vacuum arms employed may be readily varied without departing from the spirit of the present invention.

Each vacuum arm 56*a–d* is supported for vertical movement allowing the vacuum arm 56*a–d* to move within the bins 42*a–d*, 43*a–d*, 44*a–d* and retrieve or drop a sample chip 34 therein. As such, each vacuum arm 56*a–d* includes a contact tip 68 supported by a piston 70 connected to a vacuum control source 71 interfaced with the processing unit 120. In practice, once the gantry 38 is aligned with an appropriate opening, the piston 70 is actuated by the vacuum control source 71 to move downwardly and the contact tip vacuum control source 73 applies a vacuum to the contact tip 68 in a predetermined manner. When the vacuum tip 68 contacts the sample chip 34, the applied vacuum pulls the top sample chip 34 toward the contact tip 68 and retains it thereon until such a time that the applied vacuum is released.

The processing unit 120 allows the four vacuum arms 56*a–d* to work in any desired order to optimize the performance of each station. For example, the vacuum arms 56*a–d* need not pick up sample chips 34 from the same aligned bins at the same time; each vacuum arm 56*a–d* is designed to function independently of the other vacuum arms 56*a–d*.

Referring to FIGS. 3–7, the collection bins 20 are supported upon a track 36 below the horizontal support platform 40. In this way, the collection bins 20 are permitted to move from row to row, and collating station 12 to collating station 12, while collecting the variety of sample chips 34 housed within the storage bins 26*a–d*, 28*a–d*.

Each collection bin 20 includes an elongated tubular case 72 with an open top end 74 and a closed bottom end 76. Each collection bin 20 is also provided with a pair of rollers 78 shaped and dimensioned to engage the track 36 located below the horizontal support platform 40 of the collating station 12.

Figure 2:
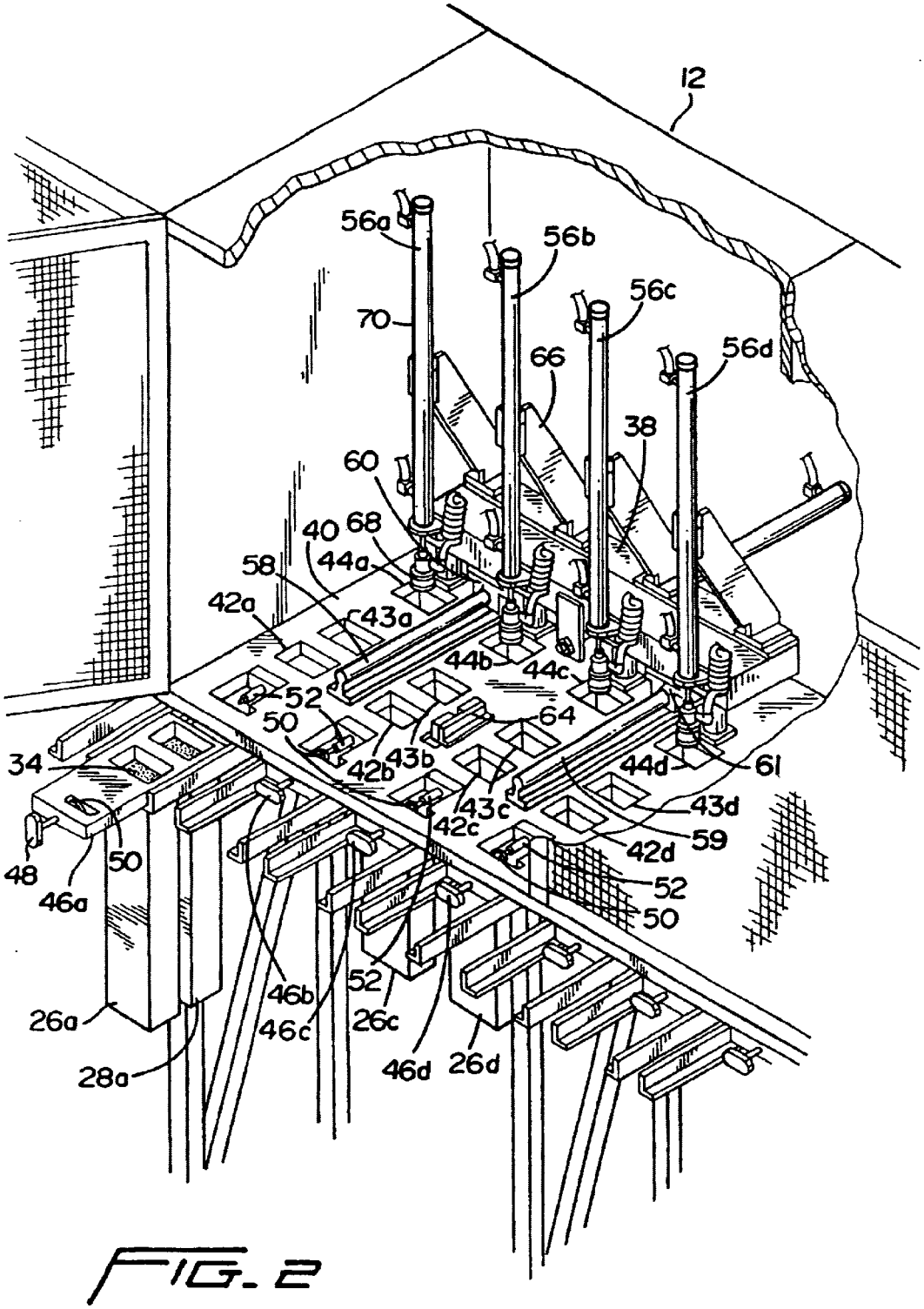
FIG. 2 is a perspective view of a collating station in accordance with the present invention.
Figure 4:
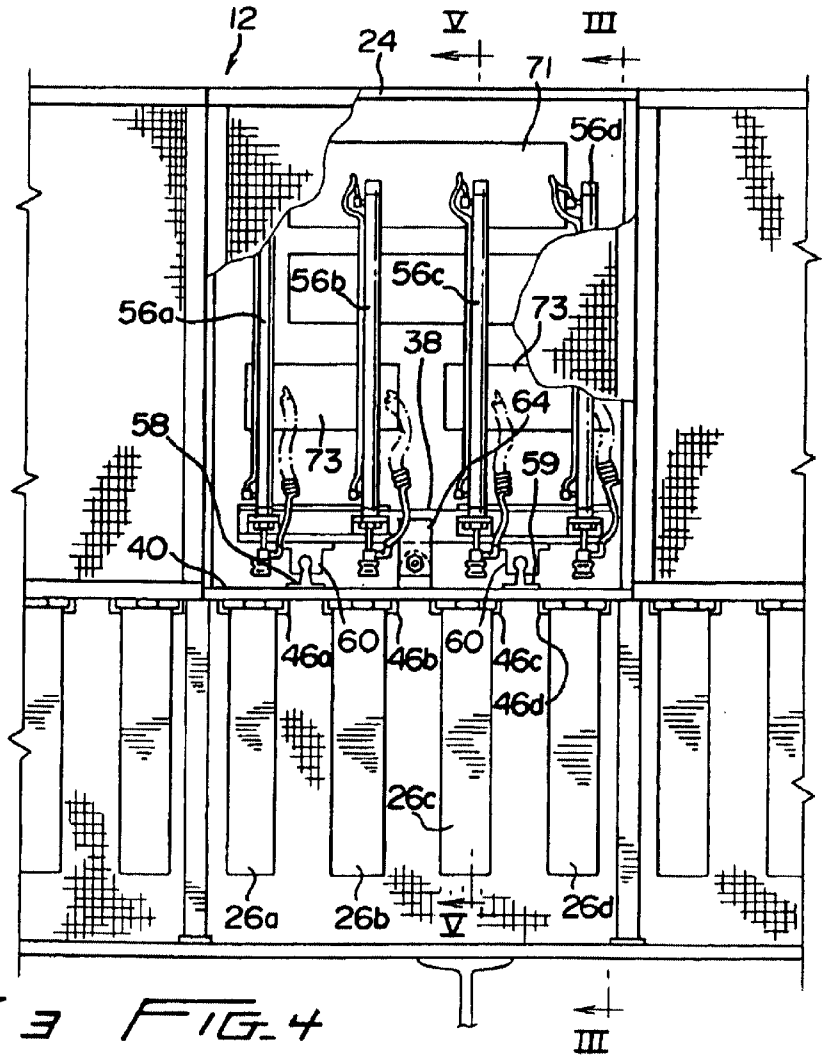
FIG. 4 is a front view of a collating station.
Figure 7:
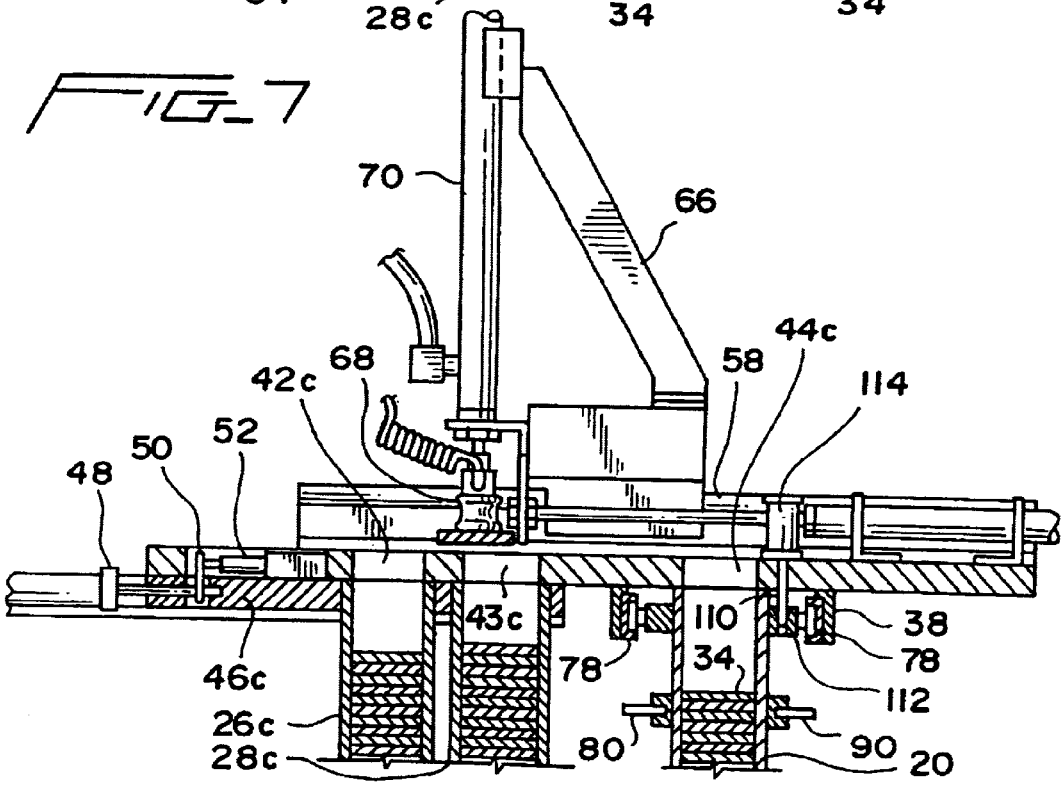

With reference to FIGS. 2 and 7, the collection bins 20 are moved along the track 36 by a series of reciprocating arms 80, 82, 84, 86 under the control of the processing unit 120 and the central control system 54. The series of reciprocating arms 80, 82, 84, 86 respectively engage projections 88, 90 extending from opposite sides of each collection bin 20 to move the collection bins 20 through the collating station 12.

More specifically, each collating station 12 is provided with four reciprocating arms 80, 82, 84, 86 which move the collating bin 20 between the various collection bin openings 44*a–d*. Each reciprocating arm 80, 82, 84, 86 includes an upwardly extending support member 92, a contact arm 94, a central section 96 and a pivot arm 98. The central section 96 is pivotally supported on the upwardly extending support member 92 which is attached to the housing framework 24 of the collating station 12.

A piston 100*a–d* is coupled to the pivot arm 98. The piston 100*a–d* applies force controlling movement of the reciprocating arm 80, 82, 84, 86. Controlled expansion or contraction of the piston 100*a–d* causes the pivot arm 98 to pivot, thereby allowing the contact arm 94 to rotate, contact the projection 88, 90 on the side of the collection bin 20 and force the collection bin 20 to the next opening 44*a–d*, or the next collating station 12.

Specifically, pistons 100*a*, 100*b* located on the rear 102 of the collating station 12 are contracted to move the collection bins 12, while pistons 100*c*, 100*d* located on the front 104 of the collating station 12 are expanded to move the collection bins 12. The choice of which direction to rotate the reciprocating arms 80, 82, 84, 86 is determined based upon spacing consideration, and those skilled in the art will appreciate many variations which are possible within the spirit of the present invention.

As briefly discussed above, the reciprocating arms 80, 82, 84, 86 are supported within the collating station 12 in a staggered arrangement such that adjacent reciprocating arms 80, 82, 84, 86 do not interfere with each other. The reciprocating arms 80, 82, 84, 86 are alternately supported along the front 104 and rear 102 of the collating station 12.

In addition, the distal end 106 of each contact arm 94 is provided with a pivoting contact member 108. The contact members 108 are pivoted to permit engagement with the projection 88, 90 of the collection bin 20 when the reciprocating arm 80, 82, 84, 86 is rotated to move the collection bin 20 forward along the track 36. However, when the reciprocating arm 80, 82, 84, 86 is rotated back to its starting position, the contacting member 108 will rotate around the projection 88, 90 of the following collection bin 20, allowing the reciprocating arm 80, 82, 84, 86 to move into position for a subsequent cycle.

Figure 3:
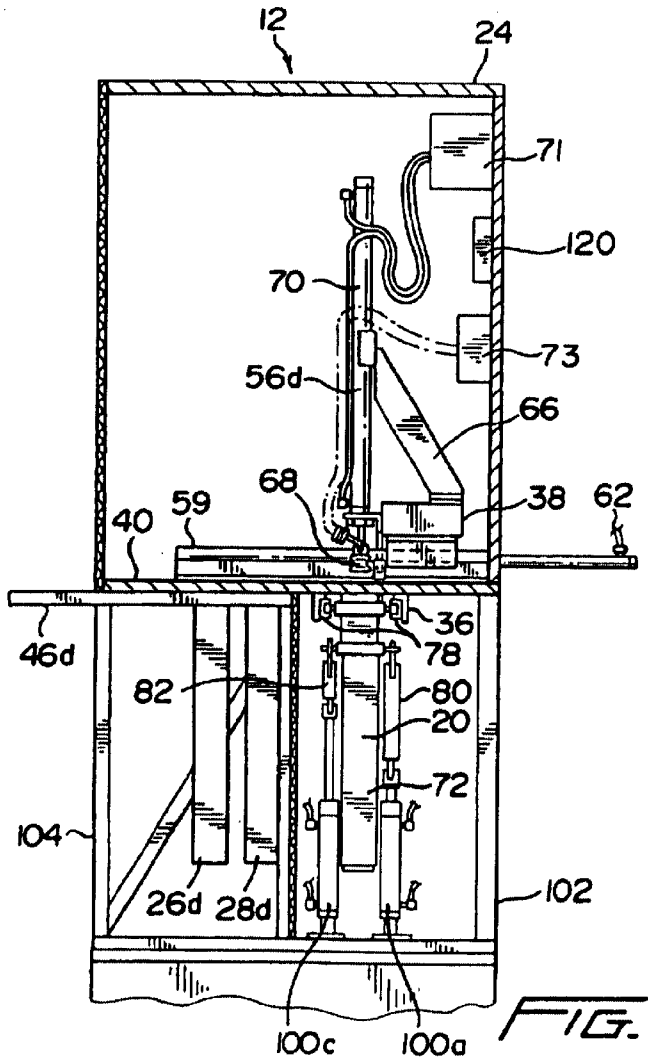
FIG. 3 is a cross sectional view along the line III—III in FIG. 4.
Figure 5:
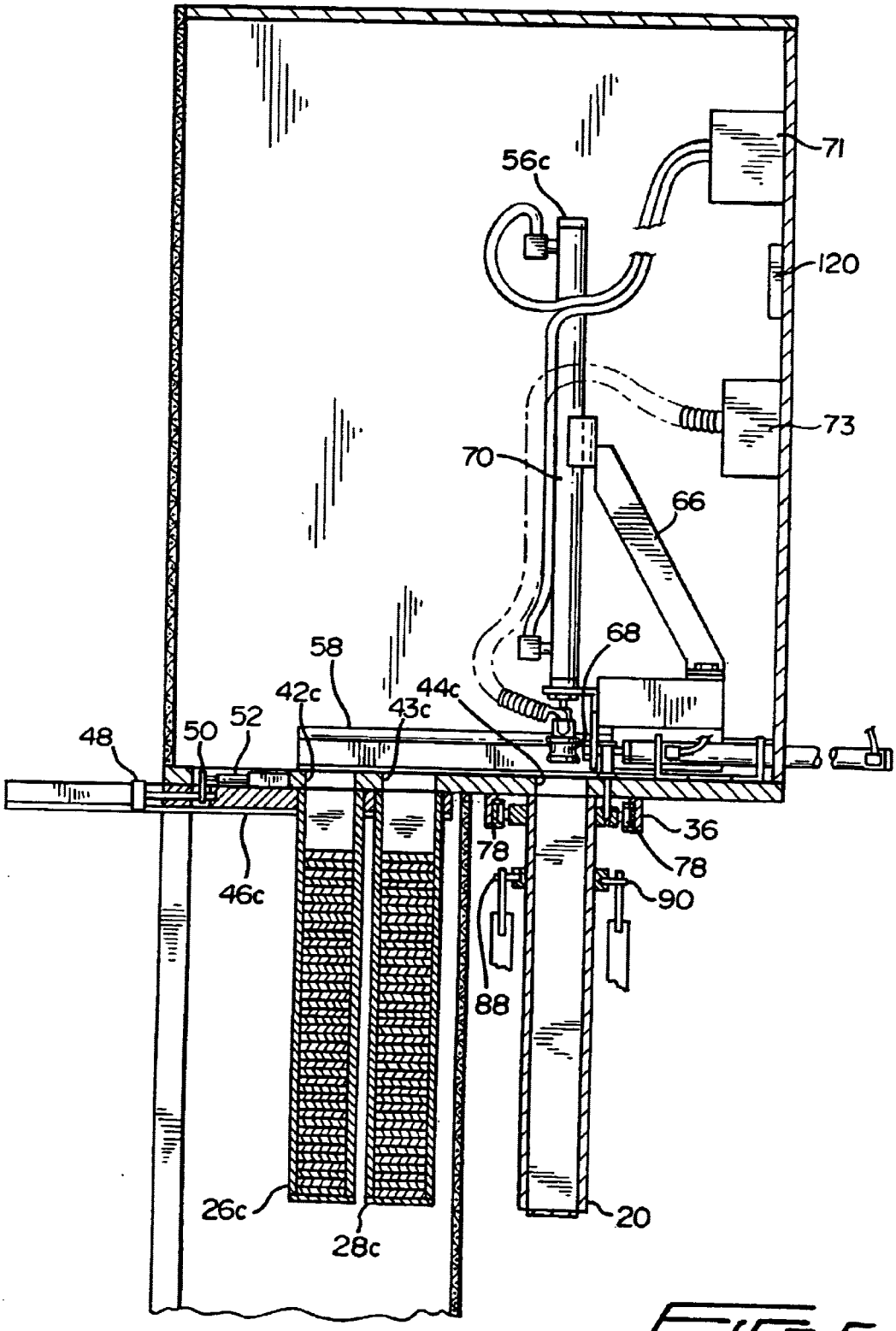
FIG. 5 is a cross sectional view of a collating station along the line V—V in FIG. 4.
Figure 6:
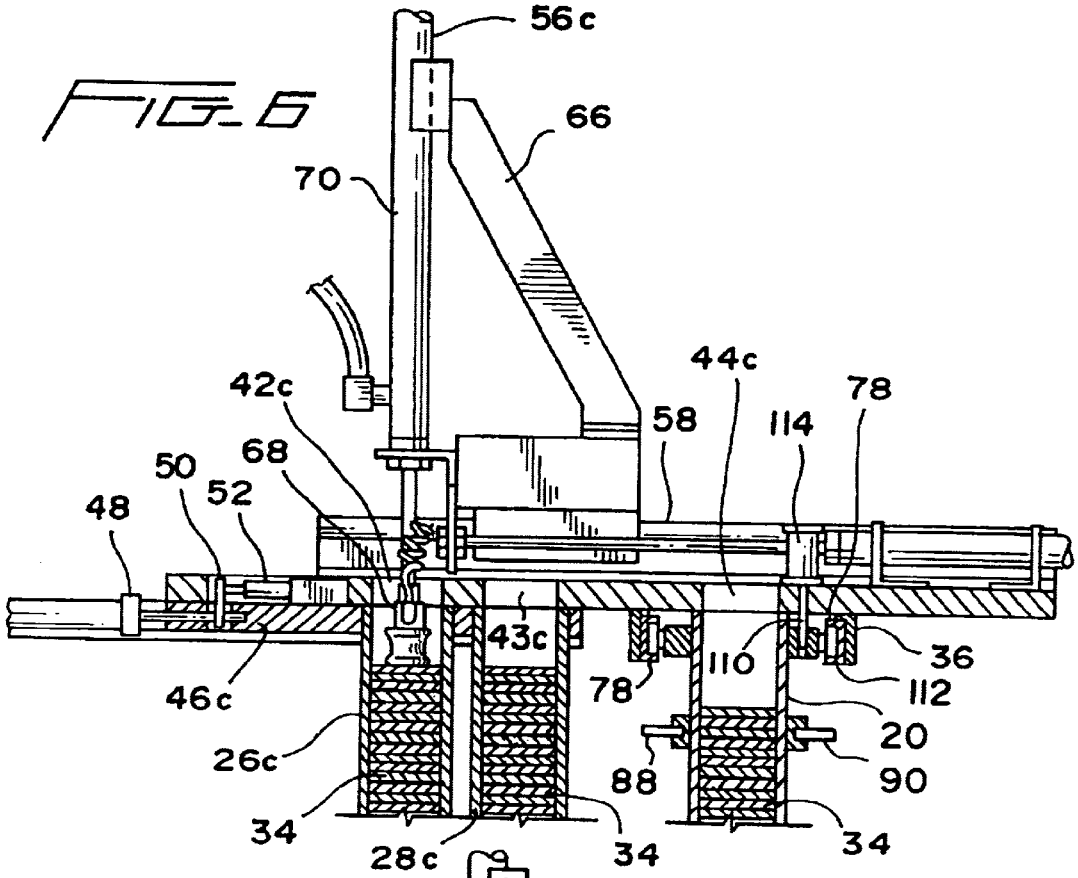
FIGS. 6 and 7 are detailed cross sectional views of the collating station showing operation of the gantry.
Figure 8:
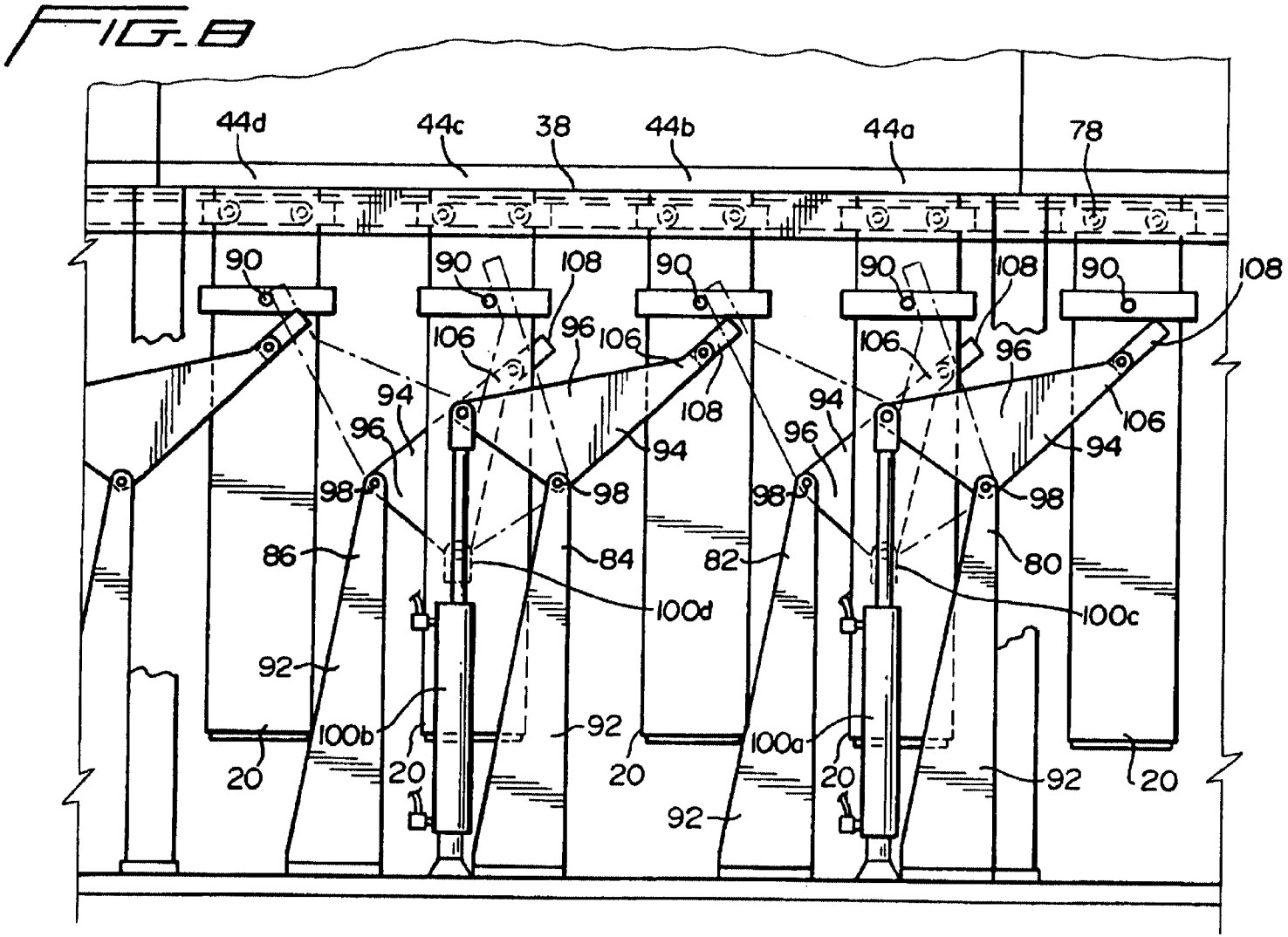
FIG. 8 is a rear view of the collating station showing the reciprocating areas in use.
Figure 9:
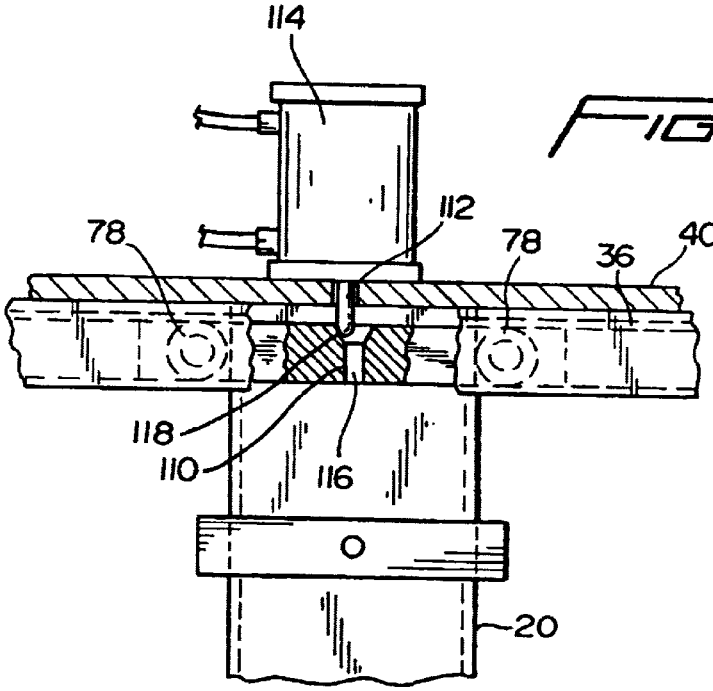
FIG. 9 is a detailed cross sectional view of the collection bin alignment system.
Figure 10:
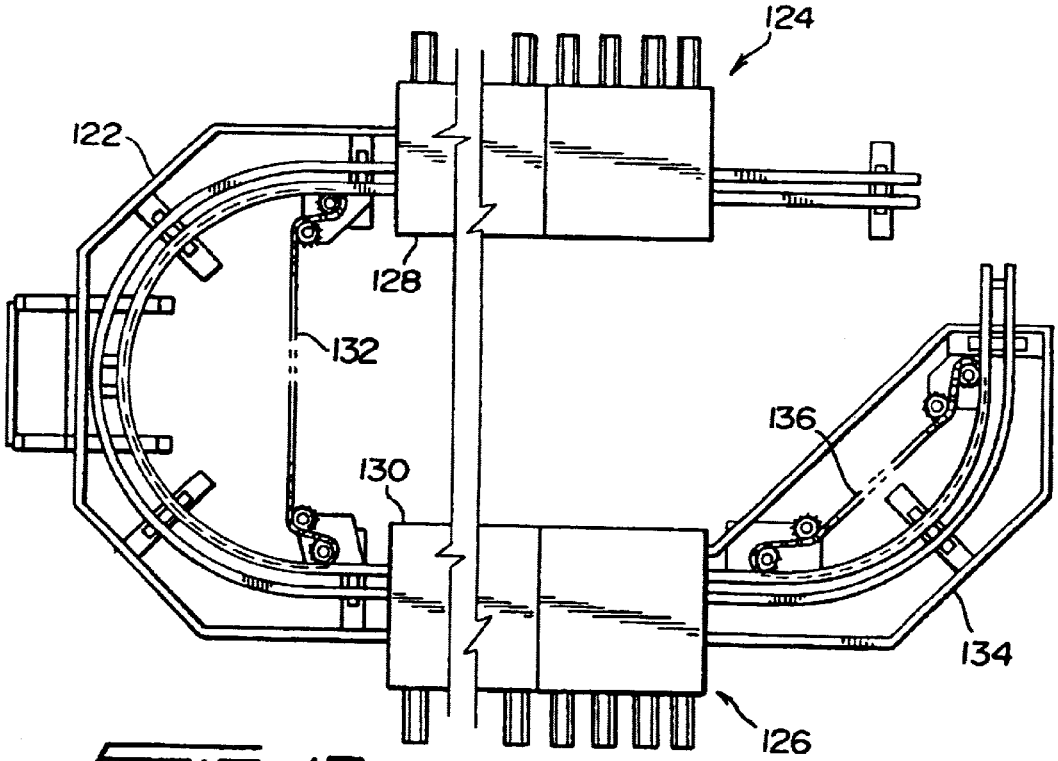
FIG. 10 is a detailed top view of the corner track and finishing track.

With reference to FIGS. 3 and 8, and as discussed above, reciprocating arms 80, 84 located along the rear 102 of the collating station 12 operate in substantially reverse of the reciprocating arms 82, 86 located along the front 104 of the collating station 12. With that in mind, the contact member 108 of the reciprocating arms 80, 84 along the rear 102 is free to rotate in a direction opposite of the contact member 108 of the reciprocating arms 82, 86 along the front 104. Despite this, and other minor variations, the projection arms 80, 82, 84, 86 function in substantially the same manner.

Controlled movement of the collection bins 20 from opening 44*a–d* to opening 44*a–d* is enhanced by the provision of a registry system. Specifically, and with reference to FIG. 8, each opening 44*a–d* is provided with a downwardly extending reciprocating pin 110 designed to engage a cone shaped alignment opening 112 formed in the top end 74 of each collection bin 20.

As the collection bin 20 moves substantially below the opening 44*a–d*, a sensor 114 actuates the reciprocating pin 110 to move downwardly. The downwardly extending reciprocating pin 110 engages the alignment opening 112. If the collection bin 20 is perfectly aligned within the alignment opening 112, the pin 110 will simply move to the bottom of the alignment opening 112. If, however, the collection bin 20 is slightly out of alignment with the opening 44*a–d*, the pin 110 will engage the cone shaped walls 118 of the alignment opening 112 as it moves downwardly and cause the collection bin 20 to move into proper alignment. The pin 110 then remains within the alignment opening 112 until the sample chips 34 are collected from the aligned supply bins 26*a–d*, 28*a–d* and placed within the collection bin 20 by the gantry 38.

Movement of the various components in each collating station 12 is controlled by a distinct processing unit 120 associated with each collating station 12. The processing units 120 of the various collating stations 12 are linked to a control system 54 which monitors and controls the operation of the overall system.

As discussed above, and with reference to FIGS. 1–9, the various collating stations 12 are connected in an end to end arrangement. The collating stations 12 are connected such that the tracks 36 which support the collection bins 20 are aligned in a manner permitting the collection bins 20 to move from station to station until they reach the finish of the apparatus.

The disclosed embodiment is substantially oval shaped and a corner track 122 is, therefore, employed to move the collection bins 20 from the outwardly bound run 124 of collating stations 12 to the inwardly bound run 126 of collating stations 12. Specifically, the corner track 122 supports the collection bins 20 as they are moved from the last collating station 128 in the outwardly bound run 124 of collating stations to the first collating station 130 of the inwardly bound run 126 of collating stations. The corner track 122 is accordingly provided with a powered gear drive 132 employed to move the collection bins 20 between the respective collating stations.

Similar, a finishing track 134 is provided adjacent the outlet of the finishing collating station 16 of the inwardly bound run 126. The finishing track 134 is also provided with a powered gear drive 136 which moves the collection bins 20 between the finishing collating station 16 to a position where an operator may retrieve the collected sample chips 34 and string them on a chain.

In use, the various supply bins 26*a–d*, 28*a–d* are first filled with sample chips 34 in a predetermined manner, and the control system 54 is programmed to fill the collection bins 20 with the appropriate sample chips 34. An operator then inserts collection bins 20 into the starting end 18 leading to the inlet of the starting collating station 14.

Once the collection bin 20 is inserted, it begins moving through the collating stations 12. The collection bin 20 stops at each preselected collection bin opening 44*a–d* where the gantry 38 moves the sample chips 34 from the supply bins 26*a–d*, 28*a–d* to the collection bins 20. Each time a collection bin 20 enters a collection bin opening 44*a–d*, the reciprocating pin 110 and alignment opening 112 system align the collection bin 20 with the collection bin opening

44*a–d* before the gantry 38 begins to fill the collection bins 20. If the reciprocating pin 110 and alignment opening 112 fail to properly align the collection bin 20 within the collection bin openings 44*a–d*, the control system 54 will issue a warning and the operator will be instructed of the problem with the specific collating station 12.

When the gantry 38 completes the transfer of sample chips 34 from the supply bins 26*a–d*, 28*a–d* of one row to the collection bins 20, the reciprocating arm 80, 82, 84, 86 pivots to move the collection bin 20 to the next collection bin opening 44*a–d*, or the next collating station 12. If a specific row of supply bins 26*a–d*, 28*a–d* is not intended for transferring sample chips 34, the control system 54 instructs the apparatus 10 and the collection bin 20 is quickly moved to the next operating row of supply bins 26*a–d*, 28*a–d*.

As the collection bin 20 moves through the collating stations 12, the gantry 38 moves sample chips 34 from the supply bins 26*a–d*, 28*a–d* to the collection bin 20 in the most efficient manner. When the collection bin 20 reaches the finishing track 134 of the apparatus 10, an operator removes the collection bin 20 and strings the sample chips 34 to create a complete sample chain.

The process is repeated such that multiple collection bins 20 simultaneously move through the apparatus 10. The control system 54 employs the various sensors dispersed throughout the collating stations 12 to control movement of the gantries 38 such that the collection bins 20 are filled in the most expeditious manner. With this in mind, four collection bins 20 may be simultaneously filled at a single collating station 12 by the same gantry 38. The gantry 38 will, therefore, move in an optimal manner to collect sample chips 34 for filling the collection bins 20 positioned therein.

When a problem occurs (for example, a supply bin is empty or an alignment problem is encountered) with any station 12 within the system, all collating stations upstream of the problem are temporarily shut down until the problem is corrected. However, the collating stations located downstream of the problem continue functioning as if no problem had occurred.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A collating apparatus for collecting sample chips, comprising:

a framework supporting a plurality of supply bins housing sample chips and a track running adjacent the plurality of supply bins, wherein the framework is composed of a plurality of distinct collating stations;

at least one collection bin shaped and dimensioned for movement on the track; and at least one gantry for transferring sample chips from the plurality of supply bins to the at least one collection bin when the at least one collection bin is aligned with respective supply bins;

wherein the gantry supports at least one pick up arm which selectively retrieves sample chips from the supply bins and places them within the at least one collection bin.

2. The collating apparatus according to claim 1, wherein the pick up arm is a vacuum arm employing vacuum pressure to retrieve the sample chips.

3. The collating apparatus according to claim 1, wherein each collating station includes at least one supply bin housing sample chips and a track running adjacent the at least one supply bin and at least one gantry for transferring sample chips from the supply bin to the at least one collection bin when the at least one collection bin is aligned with the respective supply bin.

4. The collating apparatus according to claim 1, wherein each collating station includes a plurality of supply bins housing sample chips and a track running adjacent the plurality of supply bins and at least one gantry for transferring sample chips from the plurality of supply bins to the at least one collection bin when the at least one collection bin is aligned with respective supply bins.

5. The collating apparatus according to claim 1, wherein the plurality of collating stations are positioned end to end.

6. The collating apparatus according to claim 1, wherein the gantry moves the pick up arm in a predetermined manner to pick up the predetermined sample chips.

7. The collating apparatus according to claim 6, wherein the gantry is support upon a track permitting linear movement within the framework.

8. A collating apparatus for collecting sample chips, comprising:

a framework supporting a plurality of supply bins housing sample chips and a track running adjacent the plurality of supply bins, wherein the framework is composed of a plurality of distinct collating stations;

at least one collection bin shaped and dimensioned for movement on the track; and at least one gantry for transferring sample chips from the plurality of supply bins to the at least one collection bin when the at least one collection bin is aligned with respective supply bins;

wherein the supply bins are positioned in rows of at least two supply bins, and the gantry moves along the row to retrieve sample chips.

9. The collating apparatus according to claim 8, wherein the gantry is support upon a track permitting linear movement within the framework.

10. The collating apparatus according to claim 8, wherein each collating station includes at least one supply bin housing sample chips and a track running adjacent the at least one supply bin and at least one gantry for transferring sample chips from the supply bin to the at least one collection bin when the at least one collection bin is aligned with the respective supply bin.

11. The collating apparatus according to claim 8, wherein each collating station includes a plurality of supply bins housing sample chips and a track running adjacent the plurality of supply bins and at least one gantry for transferring sample chips from the plurality of supply bins to the at least one collection bin when the at least one collection bin is aligned with respective supply bins.

12. The collating apparatus according to claim 8, wherein the plurality of collating stations are positioned end to end.

13. The collating apparatus according to claim 8, wherein the collating station includes four rows of two supply bins and the gantry includes four pick up arms.

14. The collating apparatus according to claim 13, wherein the four pick up arms are vacuum arm employing vacuum pressure to retrieve the sample chips.

15. A collating apparatus for collecting sample chips, comprising:

a framework supporting a plurality of supply bins housing sample chips and a track running adjacent the plurality of supply bins;

at least one collection bin shaped and dimensioned for movement on the track; and at least one gantry for transferring sample chips from the plurality of supply bins to the at least one collection bin when the at least one collection bin is aligned with respective supply bins;

wherein the gantry supports at least one pick up arm which selectively retrieves sample chips from the supply bins and places them within the at least one collection bin.

16. The collating apparatus according to claim 15, wherein the gantry moves the pick up arm in a predetermined manner to pick up the predetermined sample chips.

17. The collating apparatus according to claim 16, wherein the gantry is supported upon a track permitting linear movement within the framework.

18. The collating apparatus according to claim 15, wherein the pick up arm is a vacuum arm employing vacuum pressure to retrieve the sample chips.

19. A collating apparatus for collecting sample chips, comprising:

a framework supporting a plurality of supply bins housing sample chips and a track running adjacent the plurality of supply bins;

at least one collection bin shaped and dimensioned for movement on the track; and at least one gantry for transferring sample chips from the plurality of supply bins to the at least one collection bin when the at least one collection bin is aligned with respective supply bins;

wherein the supply bins are positioned in rows of at least two supply bins, and the gantry moves along the row to retrieve sample chips.

20. The collating apparatus according to claim 19, wherein the gantry is supported upon a track permitting linear movement within the framework.

* * * * *